United States Patent [19]

Garabedian

[11] 4,201,179

[45] May 6, 1980

[54] SPLIT ENGINE VACUUM CONTROL FUEL METERING SYSTEM

[75] Inventor: Arthur Garabedian, Fullerton, Calif.

[73] Assignee: Dudley B. Frank, Santa Ana, Calif.

[21] Appl. No.: 869,413

[22] Filed: Jan. 16, 1978

Related U.S. Application Data

[62] Division of Ser. No. 629,178, Nov. 5, 1975, Pat. No. 4,076,033.

[51] Int. Cl.[2] ..... F02M 13/04; F02D 17/00

[52] U.S. Cl. ..... 123/198 F; 261/23 A

[58] Field of Search ..... 123/198 F, DIG. 6, DIG. 7, 123/198 R; 261/23 A

[56] References Cited

U.S. PATENT DOCUMENTS

| | | | |
|---|---|---|---|
| 2,114,655 | 4/1938 | Leibing | 123/198 F |
| 2,166,968 | 7/1939 | Rohlin | 123/198 F |
| 2,315,183 | 3/1943 | Bicknell et al. | 123/198 F |
| 2,379,288 | 6/1945 | Ericson | 123/198 F |
| 2,623,617 | 12/1952 | Snyder et al. | 123/198 F |
| 2,771,867 | 11/1956 | Peras | 123/198 F |
| 2,837,322 | 6/1958 | Thome et al. | 261/23 A |
| 2,857,146 | 10/1958 | Carlson | 261/23 A |
| 3,121,422 | 2/1964 | Baker | 123/198 F |
| 3,249,099 | 5/1966 | Saxby | 261/23 A |
| 3,512,510 | 5/1970 | Manning | 261/23 A |

*Primary Examiner*—Ira S. Lazarus

*Attorney, Agent, or Firm*—Knobbe, Martens, Olson, Hubbard & Bear

[57] ABSTRACT

A modification to a multi-cylinder internal combustion engine to automatically restrict the flow of fuel to one group of the cylinders during a first phase of operation in response to a specified vacuum level generated by the operation of the other group of cylinders. In the first phase of operation, all fuel is blocked from entering the inactive second group of cylinders by a modified valving mechanism in the carburetor. In one embodiment of the invention, it is used in conjunction with throttle valve controls for each of the groups of cylinders, blocking not only fuel to the inactive group of cylinders, but also the flow of air to the inactive group.

14 Claims, 17 Drawing Figures

FIG. 1.
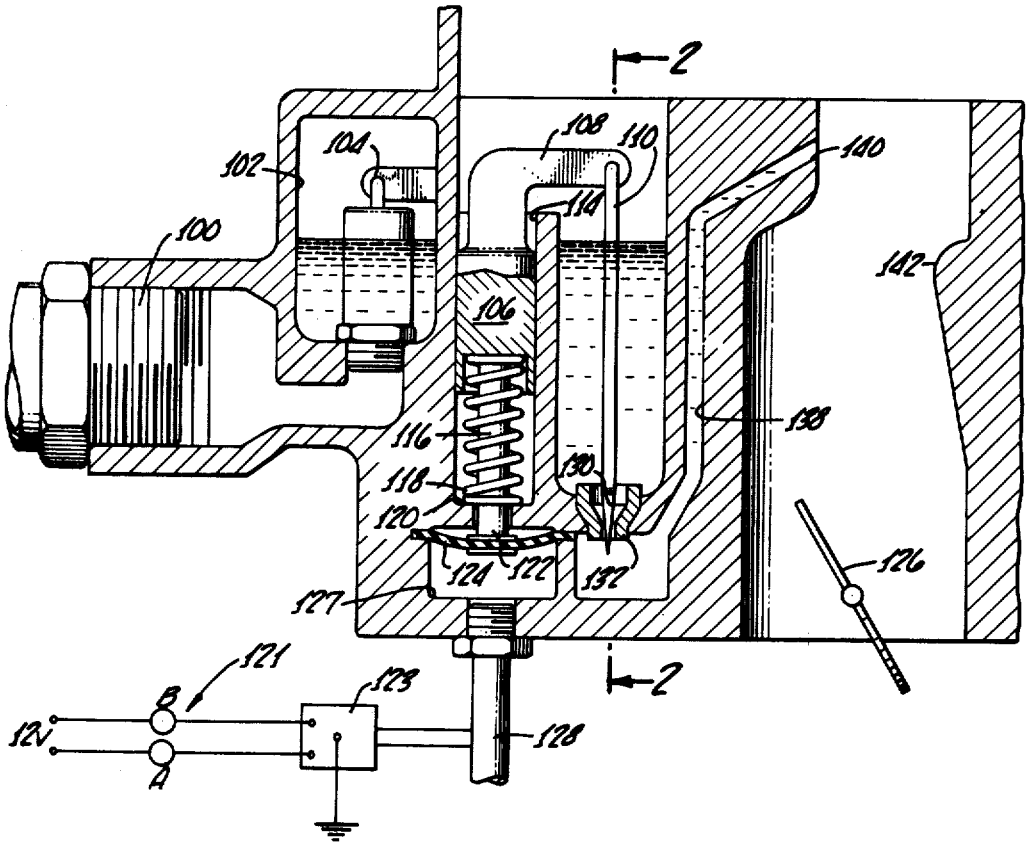
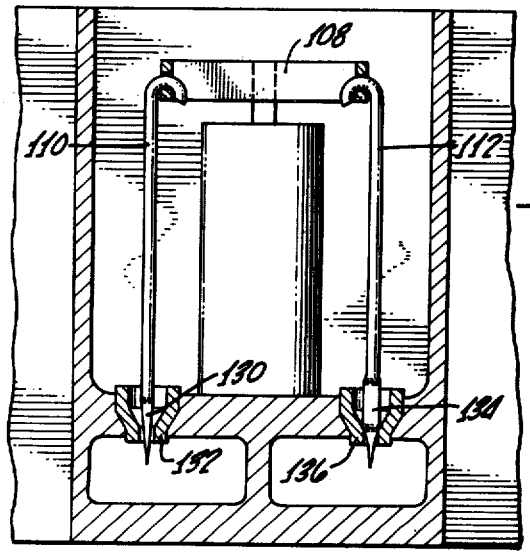
FIG. 2.

FIG. 3.
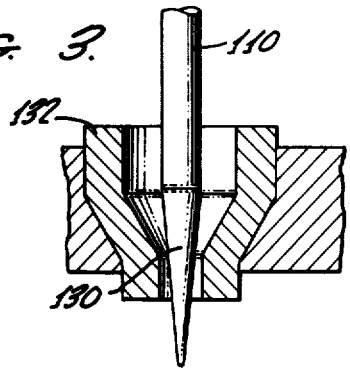
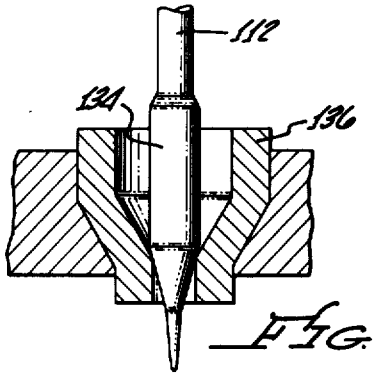
FIG. 4.
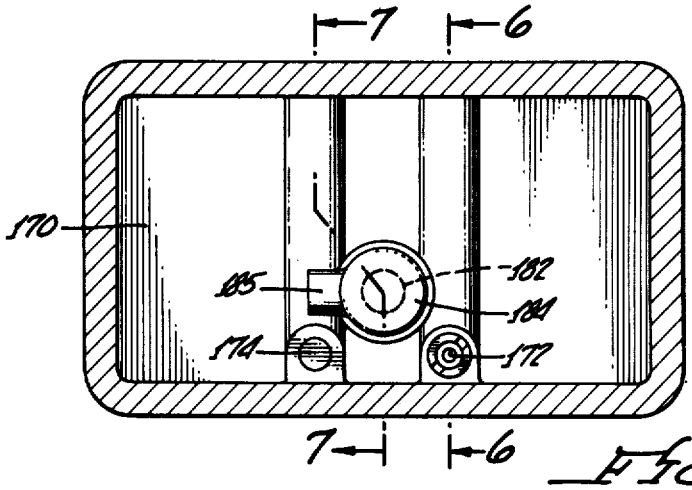
FIG. 5.
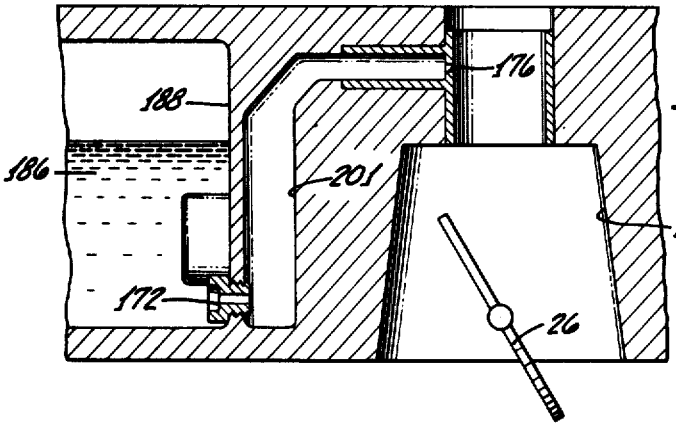
FIG. 6.

SPLIT ENGINE VACUUM CONTROL FUEL METERING SYSTEM

This is a division, of application Ser. No. 629,178, filed Nov. 5, 1975 now U.S. Pat. No. 4,076,033.

BACKGROUND OF THE INVENTION

The present invention relates to the field of internal combustion engines and more specifically relates to mechanisms used to split the operation of an internal combustion engine, so that it has the capability to alternately operate one-half or all of its cylinders.

It has long been known that internal combustion engine efficiency is greatest when cylinders were operating under relatively high loads. However, the normal operating conditions of, for instance, a typical automobile engine do not place the requisite high levels on the cylinders, resulting in uneconomical fuel consumption a great percentage of the operating time. The efficiency of the engine is directly related to the amount of air being compressed to produce the power output of the engine, since maximum air is applied to the cylinders when the throttle is open for high loads. Given the fact that cylinder load increases compression pressures which increase the engine's efficiency, the advantage of having a split engine becomes apparent by imparting high loads to half the cylinders during normal operating conditions.

Included in the design of a split engine modification is the ability to utilize all the cylinders when the engine experiences heavier loads or higher performance requirements. This provides the operator of the split engine the advantages of good fuel economy under normal operating conditions and reserve power when needed.

One area of concern, however, in operating a split engine is that the same group of cylinders always remain the active cylinders, experiencing the most wear while the remaining group of cylinders experience relatively small amount of wear and fatigue. Consequently, the engine life will be dependent upon the life of the first or active group of cylinders even though the second or inactive group of cylinders have a longer life.

Another area of concern in obtaining optimum efficiency with a split engine design has been the possible drag forces caused by the inactive pistons being turned within their cylinders by the engine crankshaft. The energy needed to turn these inactive pistons is a power drain on the active pistons, decreasing fuel economy.

SUMMARY OF THE INVENTION

The present invention comprises a modified fuel metering or valving device for use in an internal combustion engine carburetor to split the fuel flow into two separate and independent fuel flow paths to respective groups of cylinders in the engine. Fuel flow to the active group of cylinders is through a conventional valving mechanism operating in response to the power demand on the engine. However, the fuel flow to the inactive group of cylinders is controlled by a modified valving mechanism which operates only in response to the level of vacuum generated by the operation of the active cylinders.

In one embodiment of the invention, a metering rod of a power piston arrangement is altered, so that, when the engine is operating under normal conditions with low power requirements, fuel is flowing to the active cyclinders, but the modified metering rod blocks any fuel flow to the inactive group of cylinders. Only when the vacuum generated by the active cylinders in their inlet manifold drops below a specified or set level does the power piston move the modified metering rod a sufficient distance to allow fuel to enter the fuel path to the inactive cylinders to allow them to also operate, giving the engine greater power. In an alternate embodiment of the invention, the power valve of a metering block in the carburetor is modified so that one fuel flow path proceeds directly to the active group of cylinders and a second fuel flow path runs to the inactive group of cylinders. Located in the second fuel flow path is the power valve which blocks the flow of fuel when the vacuum in the manifold if the first group of cylinders maintains a specified level. Once the vacuum drops below that specified level, the power valve will open and allow the fuel to flow to the inactive cylinders.

Also included in the invention is the ability with respect to the embodiment utilizing the modified fuel metering rod to have the separate groups of cylinders alternate as the active cylinders, so that neither of the groups is operating continuously as the active group of cylinders. In other words, when the engine is operating on all cylinders and the performance requirements drop, so that one-half of the cylinders is not required, only one group of half of cylinders will act as the active cylinders. However, in the next cycle when the engine is again operating on all cylinders and the power requirements drop so that only half the cylinders are needed, the other half of the cylinders will then become the active cylinders while the previous active group of cylinders will become the inactive cylinders.

A further aspect of the present invention is its utilization in conjunction with a throttle control device which splits the air feed system into two separate entry ports, so that one air entry port operates one-half of the cylinders and the other air entry port operates the other half of the cylinders. Each feed port is operated by a separate throttle valve. The operation of the throttle valve controlling the inactive cylinders air input is responsive to the amount of opening of the throttle valve controlling the active cylinders. To help alleviate some of the inactive cylinder drag forces producing the power output of the active cylinders, the present throttle device maintains the throttle valve of the inactive cylinders closed, blocking all flow of air to those inactive cylinders. As a result, the inactive cylinders operate in essentially a vacuum environment which aids in the movement of the inactive cylinders, reducing the drag on the active cylinders as the crankshaft turns. It is believed that this greater vacuum environment aids the movement of the inactive piston from bottom dead center position to the top dead center position during the stroke. The combination of the throttle control device with the fuel metering control system provides a split engine having an operation which is very efficient and economical.

BRIEF DESCRIPTION OF THE DRAWINGS

FIG. 1 is a sectional view of the metering rod fuel control and engine carburetor;

FIG. 2 is a sectional view taken along the line 2—2 in FIG. 1;

FIG. 3 is an enlarged sectional view of the typical metering rod engaging the metering jet;

FIG. 4 is an enlarged sectional view of the modified metering rod in the closed position;

FIG. 5 is a metering block viewed from its fuel bowl side;

FIG. 6 is a sectional view taken along the line 6—6 in FIG. 5;

DETAILED DESCRIPTION OF THE INVENTION

Figure 5A:
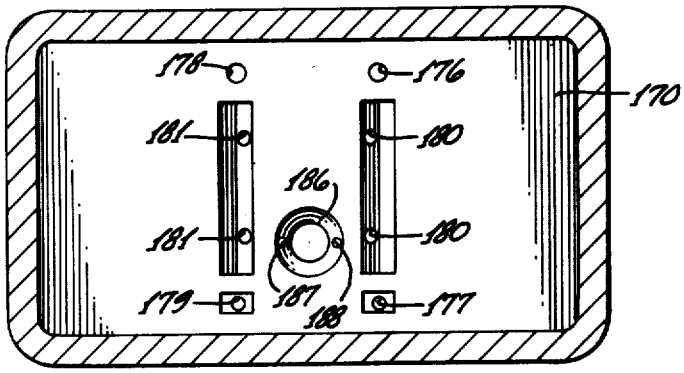
FIG. 5*a* is a metering block viewed from its carburetor side.

With respect to FIG. 1, the typical carburetor metering system is shown having a fuel inlet filter 100 and a float bowl 102 with a float assembly 104. Mounted within the float bowl 102 is a power piston 106 having an upper linkage 108 which is connected to a first metering rod 110 and a second metering rod 112 which is shown in FIG. 2. The power piston in FIG. 1 is slidably oriented in a cylinder cavity 114. The lower portion 116 of the power piston 106 is necked down and is surrounded by a spring 118 which biases the power piston toward an upward or open position. The spring 118 rests on a flange 120. The bottom 122 of the piston 106 is connected to a diaphragm 124 which is responsive to the environment within the diaphragm cavity 126 which is in fluid communication through the tube 128 with the manifold of the active cylinders in the split engine (not shown).

The small power end 130 of the metering rod 110 is designed to engage within the first metering jet 132. Similarly, as shown in FIG. 2, the small power end 134 of the second metering rod 112 is designed to engage within the second metering jet 136. Fuel which flows through the first metering jet 132 in FIG. 1 proceeds through a first fuel well 138 and up to a main discharge nozzle 140 for entrance into the main venturi 142 and the first throttle valve 26.

With respect to FIG. 2, the fuel metering rod 110 has a small power end 130 with a smaller cross-sectional area than the small power end 134 of the second metering rod 112. The first metering rod 110 in conjunction with the first metering jet 132 supplies fuel to a first group of cylinders for the normal or first stage operating conditions of the engine. The second metering rod 112 in conjunction with the second metering jet 136 controls the flow of fuel to the second group of cylinders which are inactive for normal operating conditions of the engine. When the engine is operating under normal conditions, the power piston 106 is in such a position that a small amount of fuel will pass through the first metering jet 132 to provide the necessary fuel to the first group of active cylinders to operate the engine while the small power end 136 will seat within the second metering jet blocking any flow of fuel to the second group of cylinders rendering them inactive, because the small power end 134 of the second metering rod 112 is thicker than the small power end 130 of the metering rod 110.

FIGS. 3 and 4 show the respective small power end 130 and small power end 134 of the fuel metering rods 110 and 112. They are shown in their respective positions when the engine is operating under normal road conditions with the narrower small power end 130 of the first metering rod 110 not completely engaging the first metering jet 132, allowing the passage of fuel to the active cylinders. However, the corresponding position of the small power end 134 of the second metering rod 112 is in complete engagement with the second metering jet 136, so that no fuel will pass through to the inactive cylinders.

Reference is made to FIG. 1 in the explanation of the power piston operation. Under normal operating conditions, the vacuum in the inlet manifold of the active cylinders maintains a significant enough level, so that the diaphragm 124 will counter the compressive forces of the spring 118 to maintain the power piston 106 in a lower or closed position for the second metering rod 112, causing, as shown in FIG. 4, the small power end 134 to engage with the metering jet 136 to stop flow of fuel to the inactive cylinders. However, as the power requirements are increased on the engine, the vacuum of the intake manifold on the active cylinders will drop, causing the spring 118 to overcome the vacuum held diaphragm 124 and resulting in the power piston 106 being pushed upward along with the metering rods 110 and 112. Consequently, the small power end 130 is moved further out of engagement with the first metering jet 132 while the small power end 134 is moved out of engagement with the second metering jet 136. This will allow not only more fuel to flow to the active cylinders, but also will allow fuel to flow to the inactive cylinders, so that the engine will operate on all cylinders to respond to the increased power requirements.

When the increased power requirements have diminished, the vacuum in the intake manifold of the active cylinder bank will increase to the level where the vacuum in the diaphragm chamber 126 will cause the diaphragm 124 to overcome the compressive force of the spring 118 and bring the power piston 106 down in the cylinder 114, so that the metering rods 110 and 112 will be in their respective positions shown in FIGS. 3 and 4, blocking fuel flow to the inactive side cylinders. The engine will again be operating with only half of the cylinders of the engine.

Figure 7:
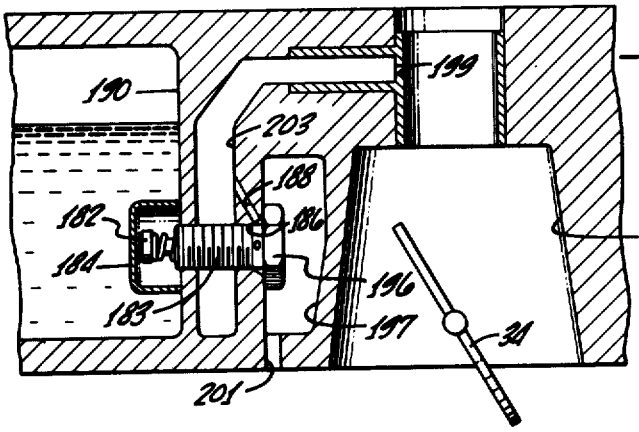
FIG. 7 is a sectional view taken along the line 7—7 in FIG. 5.

The second embodiment of the invention is shown in FIGS. 5 to 7. This embodiment is related to a modification to the metering block 170 shown in FIG. 5 which is viewed from the fuel bowl side of the carburetor. Typically, the fuel metering block 170 has a first fuel inlet 172 and a second fuel inlet 174. Fuel entering these respective inlets go to separate sides or banks of cylinders in the engine. In the present invention, the second fuel inlet 174 is plugged, so that no fuel runs through this main fuel inlet to one bank of cylinders. Because the second inlet jet 174 is blocked, no fuel can exit in FIG. 5a from the main passage 176 on the carburetor side of the fuel metering block 170 to the main discharge nozzle for the inactive group of cylinders. Furthermore, no fuel will exist the idle passage 177 to the secondary group of cylinders. On the other hand, fuel which enters the fuel inlet 172 in FIG. 5 will discharge from the main fuel passage 178 on FIG. 5a to the discharge nozzle for the active group of cylinders. Furthermore, fuel will also exist from the idle passageway 179 to the active group of cylinders. The ports 180 are air bleed ports for the blocked fuel passage or inlet 174 while the ports 181 are air bleed passages for the fuel inlet 172.

Located generally between the fuel inlets 172 and 174 in FIG. 5 is the fuel bowl end 182 of the power valve 183 shown in FIG. 7. In accordance with the present invention, a cover cap 184 placed over the fuel bowl end 182 of the power valve 183 to establish a fuel inlet 185 for the inactive group of cylinders. Located on the carburetor side of the fuel metering block 170 in FIG. 5a is an aperture 186 which receives the power valve 183. Located within the outer circumference of the aperture 186 are a pair of power valve channels 187 and 188 which respectively supply fuel to the active and inactive banks of the cylinders. However, in accordance with the present invention, the power valve channel 187 is plugged and the power valve channel 188 is increased in internal size to provide the main fuel passage to the inactive group of cylinders.

Figure 8:
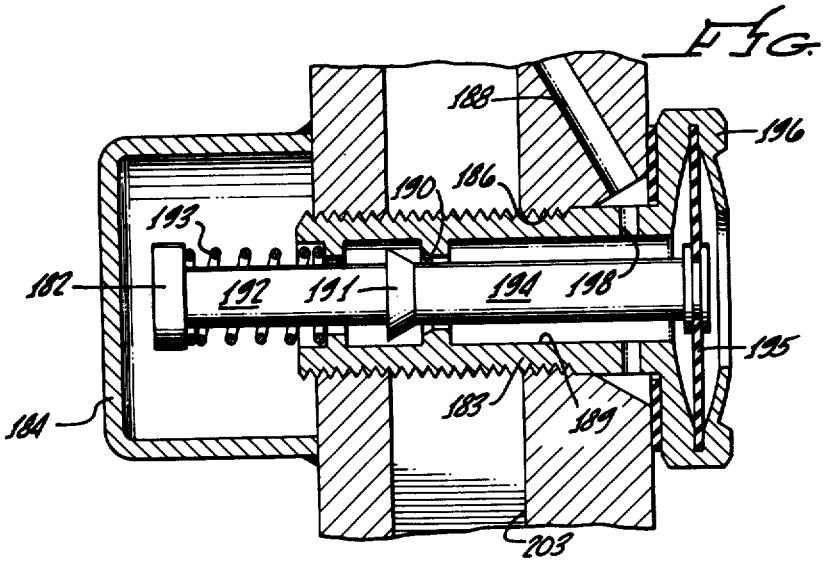
FIG. 8 is a detail sectional view of the power valve.

The power valve 183 is shown in more detail in FIG. 8. The power valve has an interior flow channel 189 having an inlet valve seat 190 on which a valving member 191 seats. The valving member has a central shaft 192 on which is mounted an enlarged metering bowl end 182 of the power valve which has a diameter greater than the diameter of the central shaft 192. A biasing spring 193 is mounted around the valving member and is contained between the power valve 183 and the fuel bowl end 182 of the power valve. The spring 193 biases the valving member 191 toward an open position off the valving seat 190. Also connected to the valving member 191 is a diaphragm shaft 194 which connects to a diaphragm 195 located in the response side 196 of the power valve 183 in fluid communication with the diaphragm chamber 197 in FIG. 7. Also adjacent the diaphragm end 196 of the power valve is an outlet port 198 in FIG. 8 which leads through the power valve channel 188 and into the second fuel discharge nozzle 199 in FIG. 7. Fuel leaving the discharge nozzle 199 enters a venturi 200 and flows down through a secondary throttle 34.

With respect to the operation of the alternate embodiment shown in FIGS. 5 through 8, fuel enters through the primary inlet 172 in FIG. 6 up through the first fuel path 201 into the venturi 202 and through the throttle 26 to supply fuel to the first group of active cylinders when the engine is operating under normal load conditions. When the vacuum generated in the inlet manifold of the active cylinders reaches a high enough vacuum, the diaphragm 195 will move to the right in FIG. 8 closing the valving member 191 onto the valve seat 190 by its connection with the diaphragm shaft 194. Therefore, no fuel is allowed to flow into the second fuel path 203 in FIG. 7, preventing any fuel supply to the second or inactive group cylinders. When the engine experiences greater performance requirements or increased load, the vacuum will drop within the inlet manifold of the active cylinders which is transmitted to the diaphragm chamber 197, allowing the spring 193 to overcome the diaphragm 195 and open the valving member 191 to allow fuel to flow through the interior flow channel 189 of the power valve and into the second fuel path 203. As a result, the second or inactive group of cylinders receives a supply of fuel to generate power to the engine in response to the increased load requirement. Once the increased load requirements on the engine have subsided, the vacuum will again increase above a specified level in the inlet manifold to the active cylinders, so that the vacuum in the diaphragm chamber 197 will be great enough to again move the diaphragm 195 in FIG. 8 to the right overcoming the compressive force of the spring 193 and closing the valving member 191. Again the engine will be operating on only the active cylinders.

It is important to note that the modification to the fuel metering block, which is similar to that found in the construction of Models 4150 and 4160 of Holley Carburetors, should be made so that each half of the separated fuel flows are independent of each other and sealed with respect to each other to allow the necessary vacuum operation of the diaphragm 195 to control the fuel going to one-half of the cylinders.

Figure 12:
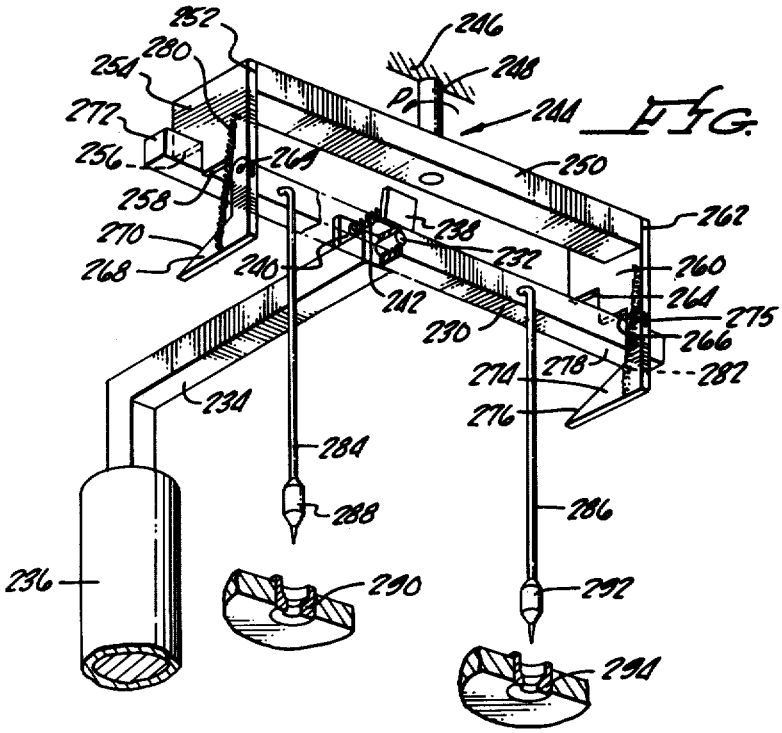
FIG. 12 is a perspective view of the alternating mechanism in a first canted position with the metering jets open.
Figure 12A:
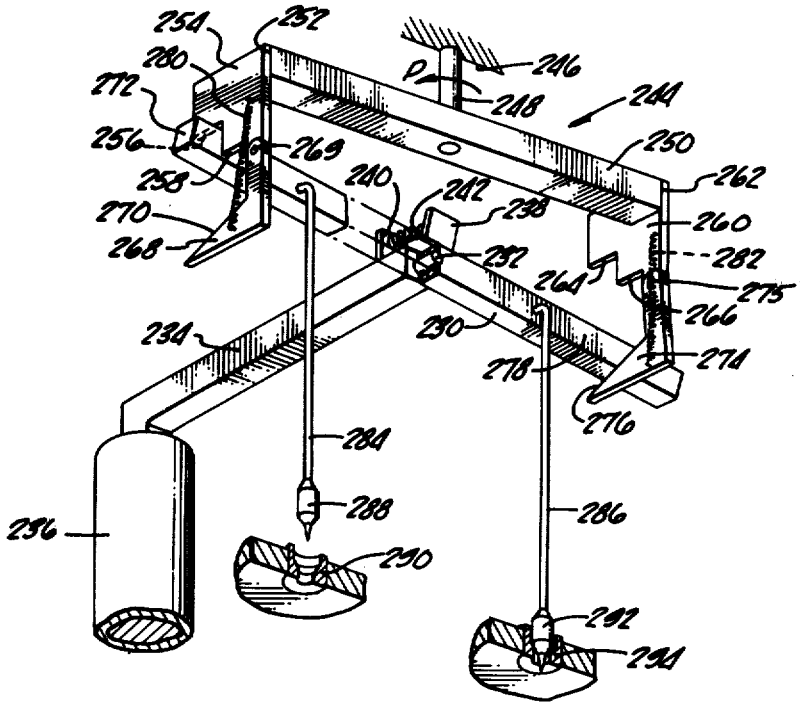
FIG. 12*a* is a perspective view of the alternating mechanism in a first canted position with one metering jet closed.
Figure 13:
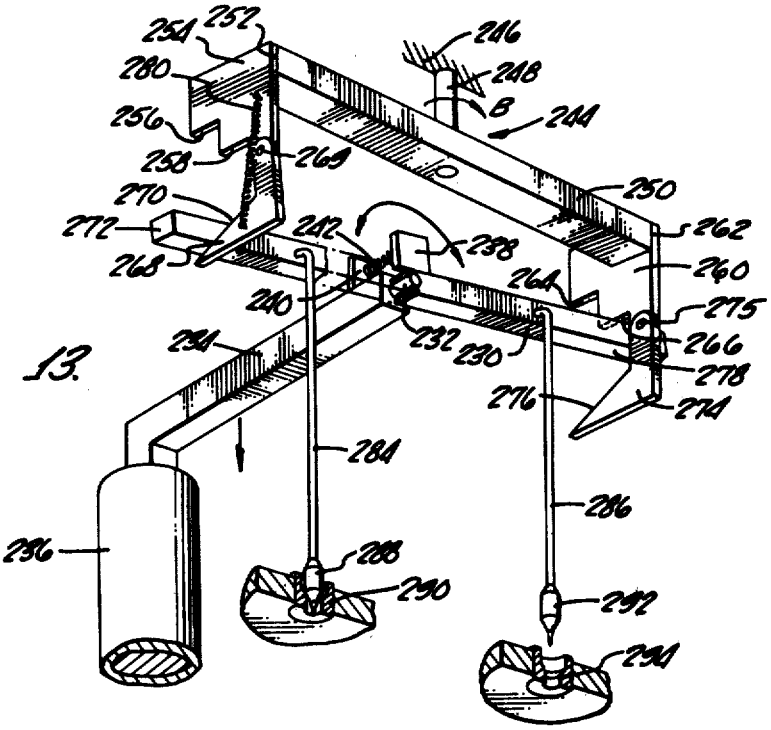
FIG. 13 is a perspective view of the alternating mechanism in a second canted position with the other metering jet closed.

The present invention also includes means for a cyclic alternating operation of the respective groups of cylinders as the active group of cylinders in the economy mode of the engine operation. After each operation of the engine at its full power mode with all of the cylinders operating, the transition back to an economy mode of operation on half of the cylinders will alternate between the two groups of cylinders, so that neither group of the cylinders is always operating under power when the engine is running. Reference is made to FIGS. 12, 12a and 13 showing a modification to the fuel metering system shown in FIGS. 1 and 2 in order to accomplish this alternating function for operation. The small power end 130 of the metering rod 110 in FIG. 2 will be modified to be of the essential same configuration as the small power end 134 of the second metering rod 112.

FIGS. 12 and 13 show the alternating device in two opposite operating positions respectively. As shown in FIG. 12 the upper linkage 230 is modified to be made longer than the comparable upper linkage 108 in FIG. 2. Furthermore, the upper linkage 230 is pivotally attached by a pivot pin 232 to the upper angled portion 234 of the power piston 236. Rigidly connected to the upper linkage 230 is a central flange 238 while an anchor flange 240 is connected to the upper angled portion 234 of the power piston. Situated between the central flange 238 and the anchor flange 240 is a compression spring 242 which acts in conjunction with the respective central flange 238 and anchor flange 240 to operate as an overcenter mechanism which will be explained in further detail herein.

Pivotally mounted above the upper linkage 230 with respect to FIG. 12 is a stop mechanism 244 which is mounted to a wall 246 of a carburetor and is free to pivot around a pivot shaft 248. The stop mechanism has a pivot bar 250 to pivot about the shaft 248. Located on one end 252 of the pivot bar 250 is a two position stop member 254 having a first retaining edge 256 and a second retaining edge 258. A similar stop member 260 is mounted on the other end 262 of the pivot bar 250. The stop member 260 also has a first retaining edge 264 and a second retaining edge 266. The first retaining edges 256 and 264 are the same distance from the pivot bar 250 while the second retaining edges 258 and 266 are the same distance from the pivot bar 250. The upper linkage 230 is oriented relative the pivot shaft 248 in such a manner that, when the first end 272 of the linkage 230 is in contact with the first retaining edge 256 of stop member 254, the second end 278 of the linkage 230 will be aligned below or in contact with the second retaining edge 266 of the stop member 260. Similarly, when the second end 278 of the linkage 230 is in contact with the first retaining edge 264 of the stop member 260, the first end 272 of the linkage 230 will be below or in contact with the second retaining edge 258 of the stop member 254. Pivotally connected to one stop member 254 is a cam member 268 having a cam surface 270 to receive the first end 272 of the upper linkage 230. Similarly connected to the other stop member 260 is a cam member 274 having a cam surface 276 which receives the second end 278 of the upper linkage 230. Both of the cam members 268 and 274 respectively pivot about pivot pins 269 and 275 and are spring biased by the respective springs 280 and 282 to provide a spring biased resistance on the respective camming surfaces 270 and 276 when contacted by either of the respective ends 272 and 278 of the upper linkage 230.

Connected to the upper linkage 230 are the first and second metering rods 284 and 286. The small power end 288 of the first metering rod 284 is designed to engage with the first metering jet 290. Similarly, the small power end 292 of the second metering rod 286 is designed to engage with the second metering jet 294. As indicated previously, both of the small power ends 288 and 292 have been modified to be larger than normal, so that when either of the small power ends 288 and 292 are respectively placed far enough down into their respective metering jets 290 and 294 the fuel will be completely stopped in its flow to that respective side of the engine being fed by the fuel going through either of the metering jets 290 or 294.

The remainder of the mechanism for controlling the flow of fuel through the fuel metering system is the same as shown in FIG. 1 with the diaphragm 124 and diaphragm cavity 126.

Turning to the operation of the alternating feature attention is directed to FIG. 12 where the upper linkage 230 is canted clockwise about the pivot pin 232 with the first end 272 in contact with the first retaining edge 256 of the stop member 254 while the second end 278 of the upper linkage 230 is closely adjacent the second retaining edge 266 of the stop member 260. Consequently, the small power end 292 of the second fuel metering rod 286 will be lower than the small power end 288 of the first fuel metering rod 284.

Neither of the small power ends 288 and 292 will engage the respective metering jets 290 and 294 when the upper linkage 230 is in contact with or closely adjacent the stop members 254 and 260 as shown in FIG. 12, because the engine is operating at the full power mode. However, when the vacuum increases in the engine manifold to the point where the economy mode of operation should occur, the diaphragm 124 in FIG. 1 pulls the power piston 106 downward slightly. The power piston 236 in FIG. 12 operates in the same manner as the power piston 106 and pulls down the upper angle portion 234 along with the upper linkage 230 to the position shown in FIG. 12*a*. The overcenter spring 242 places a downward force on the second end 278 of the upper linkage 230 and an upward force on the first end 272 of the upper linkage 230. With the downward motion of the upper angle portion 234 the overcenter spring 242 maintains the first end 272 of the upper linkage 230 in contact with the first retaining edge 256 of stop member 254 so that the first end 272 remains stationary while the second end 278 of the upper linkage moves downwardly at twice the downward rate of the upper angle portion 234 and contacts the cam member 274 in FIG. 12*a*. The downward force of the second end 278 of the upper linkage 230 on the cam surface 276 pivots the spring biased cam member outward as shown in FIG. 12*a*, allowing the small power end 292 of the second metering rod 286 to engage the metering jet 294 and block fuel flow to half of the engine's cylinders in this economy mode of operation.

The spring 282 in conjunction with the contact of the second end 278 of the upper linkage 230 with the cam member 274 will tend to bias the pivot bar 250 in the direction of arrow P. However, the position of first end 272 of the upper linkage 230 in FIG. 12 prevents any rotation of the pivot bar 250 in the direction of P. Once the small power end 292 bottoms out in the metering jet 294, any further downward movement of the upper angle portion 234 will cause the upper linkage 230 to pivot about the stationary second metering rod 286, resulting in the downward movement of the first end 272 of the upper linkage 230. When the first end 272 has cleared the second retaining edge 258 of stop member 254, the bias of spring 282 via the contact between the second end 278 and the cam member 274 causes the pivot bar 250 to move in direction of arrow P and snap over the first end 272 of the upper linkage 230 as shown in FIG. 12*a*.

While the engine is operating in the economy mode, the first end 272 of the upper linkage 230 will move up and down slightly in the area below the second retaining edge 258 of stop member 254 so that the first metering rod 284 will control the fuel flow. During this time the second metering rod has blocked all fuel flow through the second metering jet 294. When the vacuum in the manifold drops and the engine returns to the full power mode, the angle portion 234 with the upper linkage 230 moves upward and its first end 272 will contact the second edge 258 of the stop member 254, since it has been rotated to a position over the upper linkage 230. The continued upward movement of the angle portion 234 causes the upper linkage 230 to pivot counterclockwise about its contact with the second edge 258 of the stop member 254 against the bias of the overcenter spring 242. When the second end 278 of the upper linkage 230 contacts the first retaining edge 264 of the stop member 260, the center flange will have moved far enough counterclockwise to cause it to snap overcenter against the bias of spring 242, so that the bias of the upper linkage 230 will be counterclockwise in FIG. 13. It is because the second end 278 is now higher than the first end 272 of the upper linkage 230 that the central flange 238 will snap overcenter against the bias of the spring 242, resulting in the spring 242 biasing the upper linkage in a counterclockwise cant.

As a result, when the engine again returns to the economy mode of operation, the small power end 288 of the first fuel metering rod 284 will seat in the first metering jet 290, blocking all fuel flow to a different half of the engine's cylinders than when the upper linkage 230 was canted clockwise as shown in FIG. 12. It will be noted that in the orientation of FIG. 13 the first end 272 of the upper linkage 230 contacts the spring biased cam member 268 causing the pivot bar to rotate in the direction of arrow R when the other end 278 of the upper linkage 230 has moved down beyond the second retaining edge 266 of the stop member 260. The entire mechanism in FIG. 13 will subsequently operate in the same manner as discussed previously with respect to the orientation in FIG. 12 except that the fuel flow is completely blocked through the first metering jet 290 in FIG. 13 and the fuel flow is now metered through the second metering jet 294 instead the first metering jet 290 by the upward and downward movement of the second metering rod 286 via a pivotal movement of the second end 278 of the upper linkage 230 about the stationary first metering rod 284. When the engine returns again to the full power mode and the power piston 236 rises, the second end 278 of the upper linkage 230 will, therefore, contact the second retaining edge 266 of the stop member 274 while the first end 272 of the upper linkage 230 will contact the first retaining edge 256 of the stop member 254, resulting in a clockwise cant to the upper linkage 230. This will cause the central flange 238 to snap overcenter against the bias of the spring 242, wherein the spring 242 will then bias the central flange 238 in a clockwise orientation. Consequently, the cycle is repeated as discussed with respect to FIG. 12 when the engine again returns to the economy mode of operation.

This alternating mechanism operates through the above discussed cycles each time the engine changes from the full power mode to the economy mode and from the economy mode back to the full power mode. Consequently, the same group of half of the engine's cylinders are not always operating under power when the engine is the economy mode.

Included in the present invention is a set of indicator lights for placement on an automobile dashboard to reflect to the operator whether the engine is operating on half or all of the cylinders. As shown in FIG. 1, an exemplary light indicator circuit 121 can be connected to the manifold tube 128 and has a vacuum sensitive switch 123 that alternately closes between a circuit with the indicator light A for normal operating conditions with only half of the cylinders being active and a circuit with indicator light B for full operating conditions with all cylinders being active. The vacuum switch 123 is calibrated to close the circuit to light A when the vacuum in the intake manifold at the cylinders is at a high enough level to cause the engine to operate on half of the cylinders. Similarly, the vacuum switch 123 is calibrated to open circuit to light A and close the circuit to light B when the vacuum in the intake manifold drops enough to cause the engine to operate on all cylinders. The indicator lights A and B are designed to be mounted in the automobile dashboard to provide the operator an indicator as to what mode of operation the engine is in at all times. The switch mechanism between the indicators could also operate off the movement of the power piston 106 in the FIG. 1 embodiment or the movement of the power valve 194 in the FIG. 7 embodiment.

Figure 11:
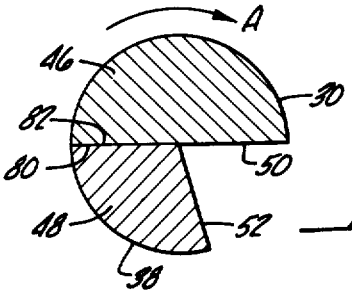
FIG. 11 is a sectional view taken along the line 11—11 in FIG. 9.
Figure 9:
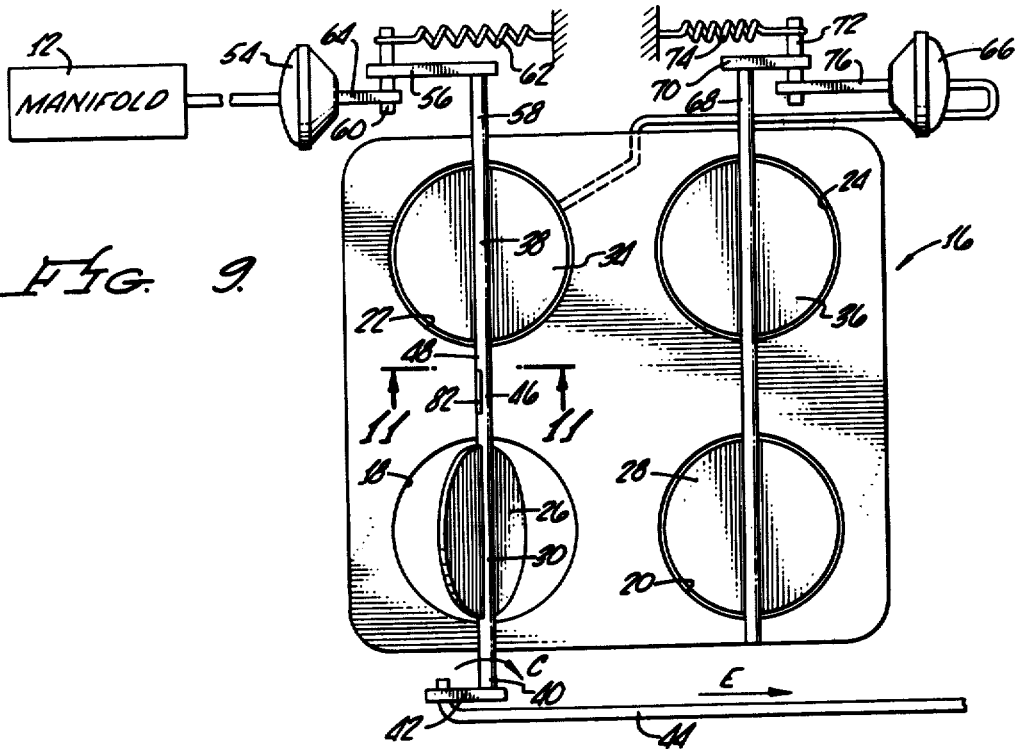
FIG. 9 is a detailed plain view of the primary and secondary throttles showing the primary throttle valve opening by the accelerator linkage.
Figure 10:
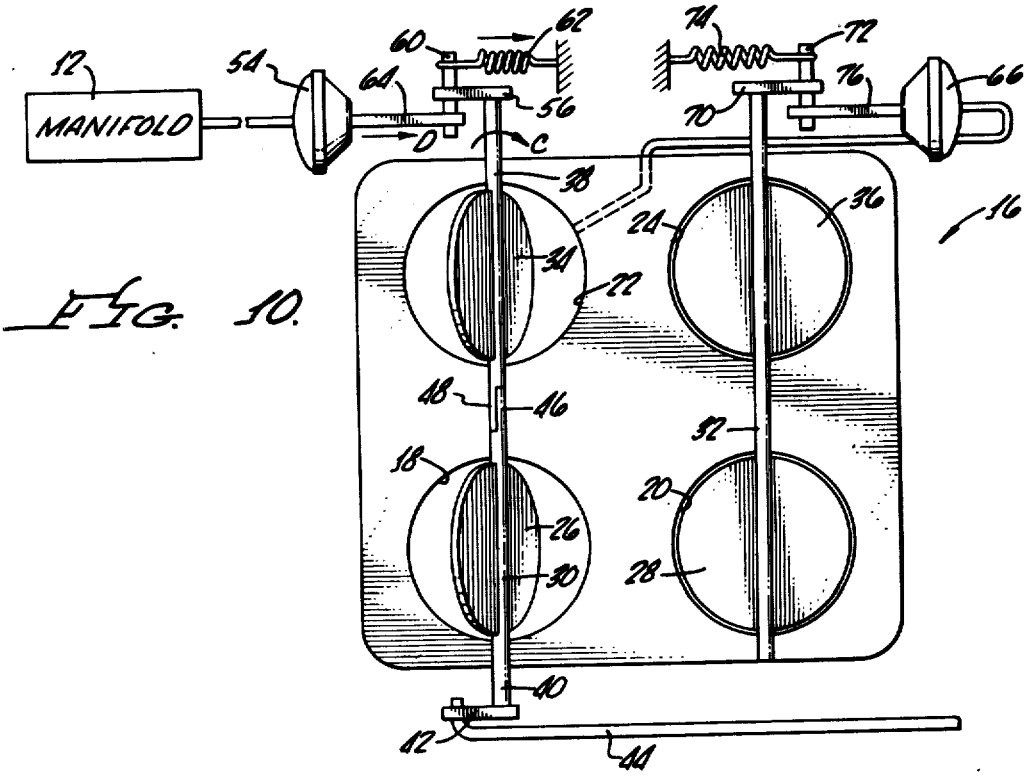
FIG. 10 is a detailed plain view of the primary and secondary throttles showing the secondary throttle valve opening by the progressive linkage and the diaphragm control.

An additional aspect of the present invention includes the application of its use in combination with an automatic throttle control system for a split engine which was disclosed in my copending application for APPARATUS FOR MODIFYING AN INTERNAL COMBUSTION ENGINE, Ser. No. 503,718, filed Sept. 6, 1974. The details of this particular aspect of the invention are shown in FIGS. 9 through 11. Located in the throttle system 16 are a primary throttle aperture 18 and a secondary throttle aperture 22, each respectively providing a passage for air or fuel air mixture to a primary group of cylinders and a secondary group of cylinders. Pivotally mounted within the throttle apertures 18 and 22 are a primary throttle valve 26 and a secondary throttle valve 34 to control the flow of air or fuel air mixture through the primary and secondary throttle apertures 18 and 22. The primary throttle valve 26 is pivotally mounted on the prime throttle shaft 30 which is connected to a responding throttle shaft 38 on which the secondary throttle valve 34 is pivotally mounted.

Connected to the outside end 40 of the prime throttle shaft 30 is a linkage member 42 which is rotated about the axis of the prime throttle shaft 30 by an accelerator control linkage 44. The inside end 46 of the prime throttle shaft 30 interconnects with the inside end 48 of the responding throttle shaft 38. FIG. 11 shows this interconnection in more detail. The inside end 46 of the prime throttle shaft 30 has a half cylindrical-shaped portion while the inside end 48 of the responding throttle shaft 38 has an approximate quarter cylindrical-shaped portion. As the prime throttle shaft 30 turns in the direction of the arrow C by the accelerator control shaft 44 of FIG. 9, the primary throttle valve 26 is opened from the closed position over the primary throttle aperture 18. When the contact surface 50 of the prime throttle surface 30 in FIG. 11 proceeds around and meets the responding surface 52, the responding throttle shaft 38 will be moved in the direction of the arrow C, opening the secondary throttle valve 34 from its generally closed position over the secondary throttle aperture 22 in FIG. 9 in order to allow the flow of air or air/fuel mixture to secondary cylinders.

It should be noted that in FIG. 11 the cross-sectional shapes of the inside end portions 46 and 48 of the respective prime throttle shaft 30 and the responding throttle shaft 38 can be varied to depend on how far it is desired to open in FIG. 9 the primary throttle valve 26 before opening the secondary throttle valve 34. This design of a progressive linkage between the prime throttle shaft 30 and the responding throttle shaft 38 can be varied to meet the needs of the particular engine.

In conjunction with or separate from the use of a progressive linkage arrangement a vacuum diaphragm mechanism 54 in FIG. 9 can be utilized to control the opening of the secondary throttle 34. An action lever linkage 56 is connected to the outside end 58 of the responding throttle shaft 38. The action lever linkage 56 is attached by a connecting pin 60 to a spring 62 which is arranged to bias the action lever linkage to rotate toward a direction to rotate and open the secondary throttle valve 34. A diaphragm stem 64 is also attached to the action lever linkage 56 by the connecting pin 60. The vacuum diaphragm mechanism 54 operates in response to the intake manifold of the active cylinders. As the vacuum decreases within the primary intake manifold with increased need for engine power, the diaphragm stem 64 will be released by the diaphragm 54 to move in the direction of the arrow D in FIG. 10, allowing the spring 62 to rotate the action lever linkage 56 and open the secondary throttle valve 34.

Because the primary throttle valve 26 is opened to give the engine power and cause the corresponding decrease in vacuum in the intake manifold 12 of the active cylinders, the rotation of the prime throttle shaft 30 will allow an opening rotation of the responding throttle shaft 38 by the diaphragm 54 release and the spring 62 force even though in FIG. 11 the contacting surface 50 has not been rotated far enough to meet the surface 52. Thus, the vacuum diaphragm acts as an aid in opening the secondary throttle valve 34 in addition to the progressive linkage between the respective inside ends 46 and 48 of the prime throttle shaft 30 and the responding throttle shaft 38. The vacuum diaphragm mechanism, however, could be used as the sole control for opening the secondary throttle valve 34 if desired. In such a case the prime throttle shaft 30 and the responding throttle shaft 38 would not connect.

Turning to the overall operation of the throttle valve automatic control and referring to FIGS. 9 through 11, as the engine is being operated under the normal relatively light load requirements or a first mode of operation, fuel and air are allowed into the primary intake manifold 12 for operation of the active cyliners. The flow of fuel and air is controlled by the first primary throttle valve 26 which is operated by the accelerator control linkage 44. As the accelerator control linkage 44 is moved in the direction of arrow E in FIG. 9, the primary throttle shaft 30 and first primary throttle valve 26 are rotated in the direction of arrow C.

During this time, the secondary throttle valve 34 is maintained in a generally closed position not contributing to the power output of the engine. When no air or air/fuel mixture is allowed into the respective pistons of the inactive or secondary cylinders, they operate in a partial vacuum environment as they are turned by the engine crankshaft (not shown). The inlet and exhaust valves of each of the secondary cylinders will operate normally, but, since the secondary throttle valve 34 is closed, the normally reciprocating secondary cylinders will pump essentially all of the air out of the inactive cylinders. Therefore, the secondary cylinders will be operating in a partial vacuum, since no air is drawn into the secondary cylinders. Consequently, the downward stroke of each of the inactive pistons creates a vacuum, in each of the respective inactive cylinders which aids in the upward stroke of each of the inactive pistons. Empirically, this vacuum environment of the inactive cylinders has been found to result in the least amount of drag forces caused by the inactive cylinders on the power produced by the active cylinders.

Referring to FIGS. 10 and 11, as the prime throttle shaft 30 is rotated open so that surface 50 on throttle shaft 30 engages surface 52 on the throttle shaft 38, a further opening of the primary throttle valve 26, indicating greater power requirements or a second mode of operation, will open the secondary throttle valve 34. This will permit air or an air/fuel mixture to enter the secondary cylinders. Furthermore, even before surface 50 of the throttle shaft 30 contacts surface 52 of throttle shaft 38, the vacuum within the active cylinders intake manifold 12 may have dropped sufficiently to cause the diaphragm 54 to move the stem 64 to allow the opening of the throttle valve 34.

When the first primary throttle valve 26 is moved to the closed position, the closing contact surface 80 in FIG. 11 of the prime throttle shaft 30 moves the closing surface 82 of the responding throttle shaft 38 to also close the secondary throttle valve 34. Also, if the vacuum in the intake manifold 12 of the active cylinders increases sufficiently, the diaphragm 54 will move the stem 64 to close the throttle valve 34.

The combination of the throttle control mechanism shown in FIGS. 9–11 in conjunction with a fuel metering control system for a split engine, as shown in FIGS. 1–8, produces extremely efficient and economical operation of a split engine. This efficiency is found to be greater than utilizing either of the systems separately. If the throttle control system is used in combination with the power piston and metering rod arrangement shown in FIGS. 1–4, no fuel or air is allowed to enter the inactive cylinders when the vacuum in the inlet manifold of the active cylinders is at a specified level. The fuel flow is stopped since the metering rod 112 in FIG. 2 has its small power end 134 in engagement with the second metering jet 136. The air flow is stopped since the progressive linkage in the throttle system allows for the primary throttle valve 26 to open while the specified vacuum through the diaphragm 54 keeps the secondary throttle valve 34 closed against the biased force of the spring 62. When the engine requires additional power resulting from increased load or increased power requirements, the vacuum in the inlet manifold the active cylinders will drop causing the diaphragm 124 in FIG. 1 to allow the power piston 106 to raise under the compressed force of the spring 118, raising the metering rod 112 allowing fuel to flow out through the secondary metering jet 136. Similarly, the reduced vacuum wil cause the spring in FIG. 9 to overcome the diaphragm force 54 and open the secondary throttle 34. As a result, both fuel and air are allowed to enter the secondary or inactive cylinders causing them to operate and produce additional power for the engine as required. As will be discussed further herein, the metering rod arrangement can be set to open slightly before the secondary throttle valve in order to get a better fuel/air mixture which might otherwise contain too much air at first causing a misfire.

A similar combination of operations can be utilized with the throttle control system 16 in FIG. 9 with the metering block and power valve operation shown in FIGS. 5–8. The throttle control system can also be used in combination with a fuel injection system such as that shown in the Mick U.S. Pat. No. 2,954,022.

Figure 14:
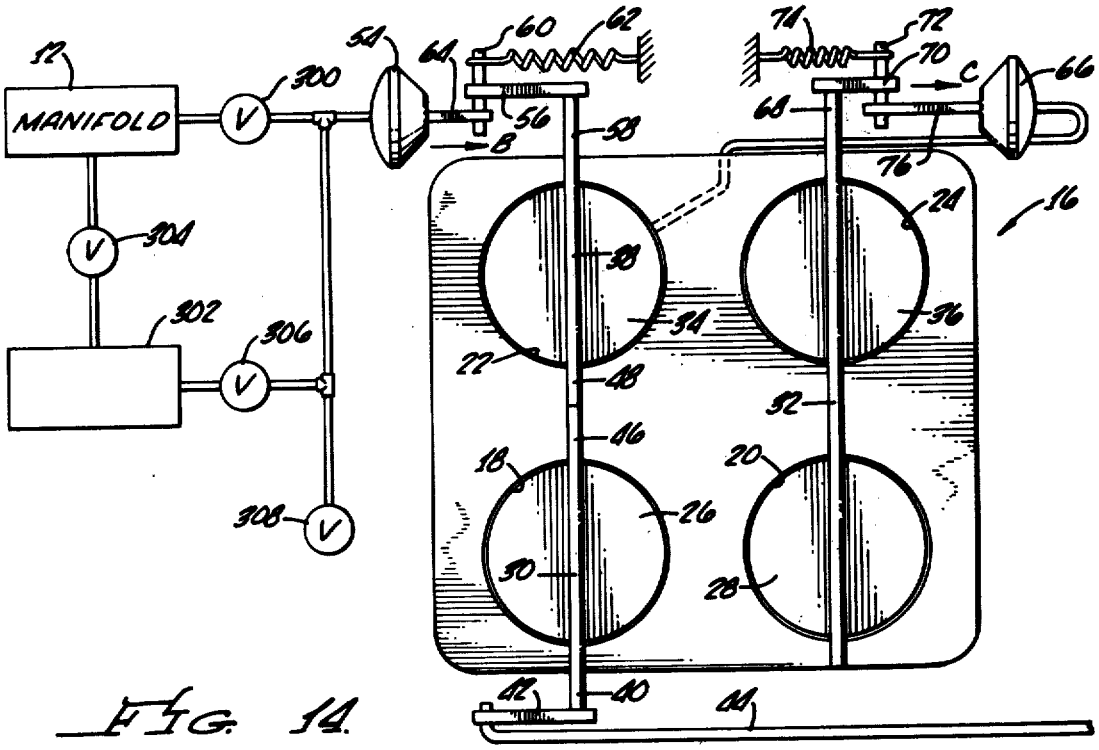
FIG. 14 schematically shows a phasing control system connected to the secondary throttle control.

FIG. 14 is essentially the same as FIG. 9 except for the addition of a schematic view of a phasing control system to not only provide for the ability to set the vacuum level for switching to the economy mode of operation, but also for gradually phasing the movement of the metering rod arrangement to prevent a possible uneven surging motion in the engine when the vaccum immediately drops. In fluid communication with the diaphragm 54 is the manifold for the inactive cylinders, so that as the vacuum increases within the manifold, the diaphragm 54 will cause the secondary throttle valve 34 to close against the bias of the spring 62. However, included within the fluid communication between the diaphragm 54 and the manifold is a one-way valve 300 which allows for the suction of air out of the diaphragm 54 as the vacuum increases within the manifold. However, once the vacuum drops within the manifold, the flow of air is not allowed to flow through the valve 300 to the diaphragm 54. Also in fluid communication with the manifold of the inactive cylinders is a collection tank 302 which also experiences a vacuum environment when the manifold becomes high. Located between the manifold and the collection tank 302 is a one-way valve 304 which allows for the passage of air out of the collection tank 302, but does not allow for air to pass into the collection tank 302 if the vacuum in the manifold drops. Therefore, if the vacuum in the manifold would immediately drop below a specified level, there would be remaining within the collection tank 302 a vacuum environment. The collection tank 302 is in fluid communication with the diaphragm 54, therefore, the diaphragm 54 will not experience the sudden drop in vacuum, since it will still be under the influence of the vacuum in the collection tank 302. Located between the collection tank and the diaphragm 54 is a restriction valve 306 which may be adjusted to determine the amount of air which is allowed to bleed into the vacuum environment of the collection tank 302.

Also in fluid communication with the collection tank 302 and the diaphragm 54 is a phasing valve 308 which is located on the dashboard of the automobile to allow an operator to directly control. The phasing control 308 determines the amount of air which the operator desires to bleed into the phasing system to control the amount of vacuum that must exist in the manifold in order to establish enough vacuum in the diaphragm 54 to hold the throttle valve 34 closed. With respect to the collection tank 302 and the restriction valve 306, the amount of air which is allowed to bleed into the collection tank 302 will determine the quickness in response to the movement of the spring 62 against the diaphragm 54 as the vacuum decreases.

In operation, therefore, if the engine is in the economy mode with a vacuum in the manifold high enough to cause the diaphragm 54 to hold the secondary throttle valve 34 closed against the bias of the spring 62 and the vacuum suddenly drops in the manifold, the one-way valves 300 and 304 will respectively prevent a flow of air into the diaphragm 54 and the collection tank 302. The diaphragm 54 will remain under the influence of the vacuum environment remaining in the collection tank and will not allow the spring 62 to immediately overcome the pull of the diaphragm 54, keeping the secondary throttle valve 34 closed. Air will be bled into the collection tank 302 and the diaphragm through the phasing valve 308, resulting in a gradual reduction of the vacuum in the diaphragm to permit a smoother transition of the engine from the economy mode to the full power mode by having the secondary throttle valve 34 open in a responsive but gradual motion eliminating any possible sudden pulling motion in the engine. The restrictor valve 306 is used to set the desired amount of air to be bled into the collection tank regardless of the setting on the phasing valve 38. Even with the phasing valve 308 allowing air into the system, the collection tank 302 has enough of a vacuum to prevent the diaphragm 54 from being immediately overcome by the bias of the spring 62.

The phasing valve 308 is basically used by the vehicle operator to selectively set the vacuum level at which the engine will switch between the economy and full power mode of operation. Consequently, an operator can adjust the responsiveness of the engine, so that he will get full power operation sooner if desired by allowing more air to be bled into the diaphragm 54. Therefore, even when there is a vacuum in the manifold, if the amount of air coming in through the phasing valve 308 is great enough, the engine will still operate at full power since not enough vacuum will be in the diaphragm 54 to hold the secondary throttle valve closed.

Figure 15:
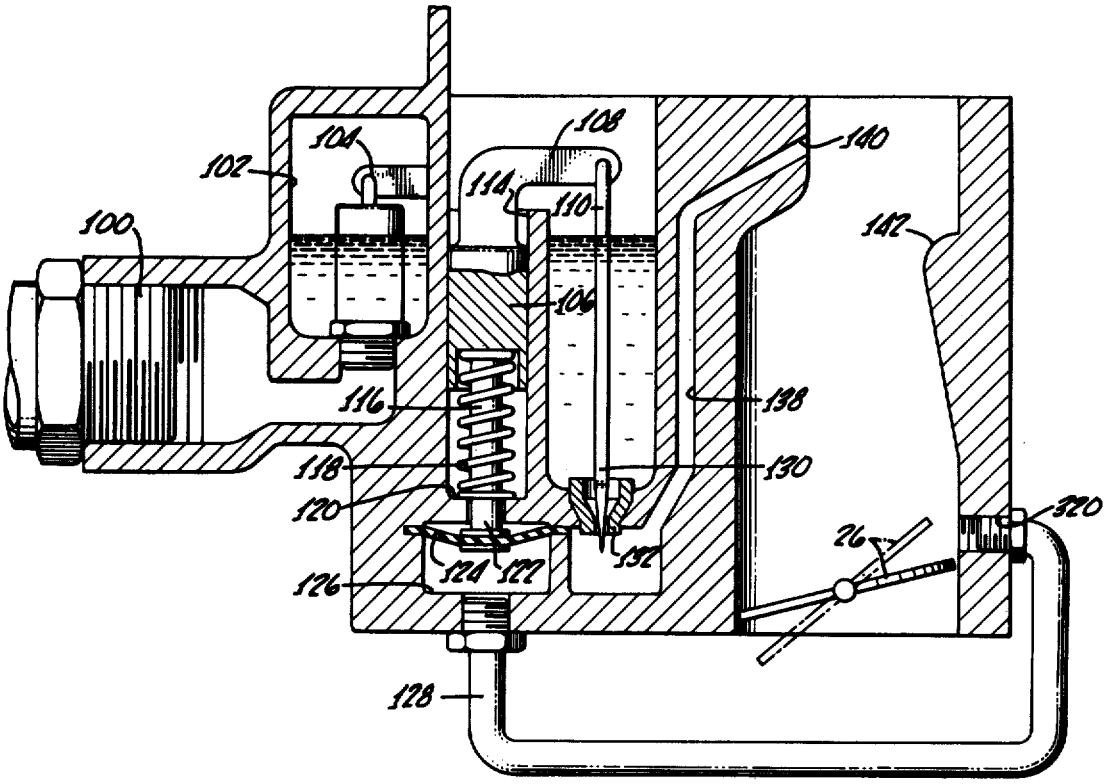
FIG. 15 shows the off idle port connection to the power piston diaphragm.

In many existing carburetors, there is an off idle port which it utilized to sense the vacuum at a position just above the throttle plate when the throttle plate is essentially in an idle position. Typically, the operation of the automobile's distributor utilizes the off idle port to sense the vacuum change as the throttle plate opens further. In the present invention, the off idle port is used in an alternate arrangement as shown in FIG. 15 where the vacuum cavity 126 is in fluid communication with the off idle port 320. Consequently, when the throttle plate 26 is in its position shown in solid lines, the off idle port is sensing no vacuum and, therefore, the spring 118 raises the power piston 106 to allow fuel to enter both sides of the engine. However, as the throttle plate 26 is opened to the position shown in phantom, the off idle port 320 senses a vacuum which will cause the diaphragm 124 to move against the spring 118 and tending to close the fuel metering rod in the inactive side of the engine if the vacuum is sufficient.

The reason for this utilization of the off idle port is to have the engine operate on all cylinders when initially starting, for instance, in a cold environment or under a load with the air conditioning connected, to provide the necessary power to overcome the higher loads on the engine. However, once the engine has warmed and the automobile is moving, so that the throttle plate 26 is opened somewhat to give additional power, the off idle port will sense a vacuum and, therefore, cause the power piston to close the fuel meter rod on the inactive side of the cylinders if a sufficient vacuum is sensed by the diaphragm.

The present invention envisions the utilization of the modification to either the fuel metering rod system or the power valve system with the throttle plate operation modification so that the fuel metering system will operate in response to sensing vacuum off the off idle port 320 in FIG. 15 while the opening of the secondary throttle plate 34 in FIG. 14 will be controlled by the phasing circuit shown in FIG. 14. Therefore, when the automobile is moving along in normal operating conditions on a four cylinder mode of operation, and the primary throttle valve 26 is open to the position in phantom in FIG. 15, so that there is a vacuum that keeps the power valve or meter rod closed to the inactive side of cylinders, it is desirable to have some fuel enter the inactive side of the cylinders just prior to the opening of the secondary throttle valve 34. This is because the opening of the secondary throttle valve 34 allows a large volume of incoming air to rush into the engine which normally would not receive enough fuel to provide the desired mixture and the engine will misfire making the operation rough and cause the exhaust of unburned gases. Therefore, the phasing circuit in FIG. 14 is adjusted through the valve 306, so that when the vacuum does drop in the manifold, the collection tank 302 will retain some vacuum which will allow for the gradual release of the diaphragm 54 to the bias of the spring 62 to allow a more gradual opening of the secondary throttle valve 34. Furthermore, when the throttle plate 26 is opened to demand more power, the vacuum drop will be noted more quickly in the diaphragm cavity 126, so that the spring 118 will quickly raise the power piston 106 and allow fuel to enter the inactive side of the cylinders, so that fuel is available to properly mix with the large volume of air in coming through the secondary valve 34 as it gradually opens. This comination of operating the fuel metering system with the off idle port and operating the throttle valves off of the phasing circuit will provide a smoother transfer between the economy mode and the full power mode and will encourage the complete burning of fuel which is placed in the inactive side of the cylinders.

WHAT IS CLAIMED IS:

1. A split engine carburetor for independently controlling the flow of fuel to respective halves of the number of an engine's cylinders, said carburetor comprising:

a first fuel path located in said carburetor;

a second fuel path located in said carburetor, said first fuel path in fluid communication with one-half of said cylinders, said second fuel path in fluid communication with the other half of said cylinders;

valving means for controlling the flow of fuel through said second fuel path to said other half of said cylinders, said valving means in fluid communication with an intake manifold of said one-half of said cylinders, wherein said valving means comprising:

a metering block; and a power valve mounted in said metering block, said power valve and said metering block modified to have two separate fuel flow lines, with one fuel flow line going through said metering block and the other fuel flow line going through said power valve, said other fuel flow line having an inlet fuel channel within said power valve, said inlet channel being movable with said power valve, said power valve allowing flow of fuel only to said other half of said cylinders when said power valve is opened by said biasing means;

means connected to said valving means for biasing said valving means toward an open position; and means connected to said valving means and responsive to a specified vacuum in said intake manifold for moving said valving means toward a closed position, said engine operating on only said one-half of said cylinders when said vacuum in said manifold is above said specified level by closing said valving means and preventing said fuel flow to said other half of said cylinders.

2. A split engine carburetor for controlling the flow of fuel to the cylinders of an engine in order to allow continuous fuel flow to one-half of said cylinders and intermittent fuel flow to the other half of said cylinders, said carburetor comprising:

a plate member;

a first fuel path within said plate;

a second fuel path within said plate, said first fuel path in fluid communication with said one-half of said cylinders, said second fuel path in fluid communication with said other half of said cylinders;

a power valve mounted within said second fuel path;

means connected to said power valve for biasing said power valve to an open position; and means connected to said power valve and in fluid communication with a manifold of said one-half of said cylinders for moving said power valve to a closed position, said power valve being in said closed position when vacuum in said manifold is above a specified level.

3. A split engine carburetor as defined in claim 2 wherein said moving means comprises a diaphragm responsive to variations in vacuum of said manifold, maintenance of said vacuum above said specified level causing said power valve to move to said closed position against the said biasing means, a decrease of said vacuum below said level allowing said biasing means to move said valve to said open position permitting said fuel to flow through said second fuel path to said other half of said cylinders.

4. A split engine carburetor for alternately running an engine on half of its cylinders and all of its cylinders according to power demands on said engine, said carburetor comprising:

a shifting power piston;

a first metering rod connected to said piston;

a second metering rod connected to said piston, said first metering rod controlling flow of fuel to one-half of said cylinders, said second metering rod controlling flow of fuel to the other half of said cylinders;

a first metering jet for receipt of said first metering rod;

a second metering jet for receipt of said second metering rod, each of said first and second metering rods having a small power end which blocks a certain amount of fuel flow through said first and second metering jets depending upon movement of said power piston;

means connected to said piston for biasing said piston to a first position, said piston in fluid communication with a manifold of one of said first half and said other half of said cylinders;

means connected to said piston and responsive to vacuum variations in said manifold for moving said piston to a second position, said engine operating on one of said one-half and said other half of said cylinders when said piston is in said second position, one of said first and second metering rods seated in one of said respective first and second metering jets when said piston is in said second position; and means connected to said metering rods for alternately and separately blocking fuel flow to one of said one-half and said other half of said cylinders, said first and second metering rods alternately blocking said flow of fuel to said respective said one-half and said other half of said cylinders each time said piston is moved to said second position, said flow of fuel being to both said one-half and said other half of cylinders when said piston is in said first position.

5. A split internal combustion engine having two stages of operation, said engine comprising:

at least one primary cylinder;

at least one secondary cylinder;

a first fuel path in fluid communication with said primary cylinder;

a second fuel path in fluid communication with said secondary cylinder;

a valving means located in said second fuel path;

means for biasing said valving means toward an open position;

means connected to said valving means for moving said valving means toward a closed position, said moving means responsive to a vacuum in a manifold of said primary cylinder, said valving means being closed when said engine is in the first of said two stages of operation, said secondary cylinder receiving no fuel during said first stage of operation;

a first carburetor throttle valve in fluid communication with said primary cylinder;

a second carburetor throttle valve in fluid communication with said secondary cylinder and operating in conjunction with said valving means;

an accelerator linkage means to control said first carburetor throttle valve; and means responsive to said first carburetor throttle valve for controlling said second carburetor throttle valve, said first carburetor throttle valve opening in response to movement of said accelerator linkage means to supply fuel and air to said primary cylinder during said two stages of operation of said engine, said first fuel path supplying fuel to said first carburetor throttle valve, said second carburetor throttle valve remaining in a closed position during said first stage of operation, said secondary cylinder operating in a vacuum during said first stage of operation, said second carburetor throttle valve and said valving means being moved to an open position by said controlling means and said biasing means respectively during the second stage of operation of said two stages of operation of said engine.

6. A carburetor arrangement for a split internal combustion engine having a full power mode of operation and an economy mode of operation, said carburetor arrangement comprising:

a first fuel path for fuel flow to one-half of the cylinders of said engine;

a second fuel path for fuel flow to the other half of said cylinders;

a first valving means in said first fuel path for metering the flow of fuel to said one-half of said cylinders;

a second valving means in said second fuel path for metering the flow of fuel to said other half of said cylinders;

means for biasing said first and second valving means toward an open position;

means connected to said first and second valving means and in fluid communication with the manifold of said cylinders for moving said first and second valving means toward a closed position, said moving means being responsive to a specified vacuum level in said manifold; and means connected to said moving means for alternating the closing of said first and second valving means after each transition of said engine from said full power mode of operation on all cylinders to said economy mode of operation on one of said one-half and said other half of said cylinders.

7. A split engine carburetor arrangement for independently controlling the flow of fuel to respective halves of the number of an engine's cylinders, said carburetor arrangement comprising:

a first fuel path mounted in said carburetor;

a second fuel path mounted in said carburetor, said first fuel path in fluid communication with one-half of said cylinders, said second fuel path in fluid communication with the other half of said cylinders;

a first valving means for controlling the flow of fuel through said first fuel path to said one-half of said cylinders;

a second valving means for controlling the flow of fuel through said second fuel path to said other half of said cylinders, said first and second valving means being in fluid communication with the intake manifold of said cylinders;

means for biasing said first and second valving means toward an open position;

means in fluid communication with said intake manifold for moving one of said first and second valving means toward a closed position, said moving means responsive to the vacuum reaching a specified level in said manifold; and means connected to said first and second valving means for alternating the closing of said first fuel path by said first valving means and the closing of said second fuel path by said second valving means each time said engine makes a transition from a full power mode of all cylinders operating to an economy mode of half of the cylinders operating.

8. A split engine carburetor for independently controlling the flow of fuel to respective halves of the number of an engine's cylinders, said carburetor comprising:

a first fuel path mounted in said carburetor;

a second fuel path mounted in said carburetor, said first fuel path in fluid communication with one-half of said cylinders, said second fuel path in fluid communication with the other half of said cylinders;

valving means for controlling the flow of fuel through said second fuel path to said other half of said cylinders, said valving means in fluid communication with an intake manifold of said one-half of said cylinders;

means connected to said valving means for biasing said valving means toward an open position;

means connected to said valving means and responsive to vacuum variations in said intake manifold for moving said valving means toward a closed position, said engine operating on only said one-half of said cylinders when said vacuum in said manifold is above a specified level, closing said valving means and preventing said fuel flow to said other half of said cylinders;

a first throttle valve to control airflow to said one-half of said cylinders;

a second throttle valve to control airflow to said other half of said cylinders;

means connected to said second throttle valve for biasing said second throttle valve toward an open position;

means connected to said second throttle valve and in fluid communication with said intake manifold for pulling said second throttle valve toward a closed position when the vacuum in said manifold reaches a specific level; and means in fluid communication with said manifold and said pulling means for gradually reducing the vacuum environment on said moving means when said vacuum in said manifold drops immediately so that said second throttle valve is not opened immediately, allowing some fuel to flow through said second fuel path before said second throttle valve opens to provide an adequate fuel and air mixture to avoid a misfire in said engine.

9. A split engine as defined in claim 8 wherein said means for gradually reducing said vacuum environment on said pulling means comprises:

a first one-way valve located between said manifold and said pulling means, said one-way valve allowing air to flow toward said manifold through the fluid connection between said pulling means and said manifold;

a collection tank in fluid communication with said manifold;

a second one-way valve located between said manifold and said collection tank, said one-way valve allowing air to flow toward said manifold through the fluid connection between said manifold and said collection tank, said pulling means being in fluid communication with said collection tank; and a phasing valve in fluid communication with said collection tank and said pulling means said phasing valve allowing air to bleed into said collection tank and said pulling means, said air entering said collection allowing said biasing means to open said second throttle valve as said vacuum environment decreases in said collection tank.

10. A split engine carburetor for independently controlling the flow of fuel to respective halves of the number of an engine's cylinders, said carburetor comprising:

a first fuel path mounted in said carburetor;

a second fuel path mounted in said carburetor, said first fuel path in fluid communication with one-half of said cylinders, said second fuel path in fluid communication with the other half of said cylinders;

a first throttle valve located in said carburetor to control the air and fuel mixture flow to said one-half of said cylinders, said fuel being fed by said first fuel path;

a second throttle valve located in said carburetor adjacent said first throttle valve to control the air and fuel mixture flow to said other half of said cylinders, said fuel being fed by said second fuel path;

an off idle port located in the main venturi of said carburetor adjacent said first throttle valve;

valving means for controlling the flow of fuel through said second fuel path to said other half of said cylinders;

means connected to said valving means for biasing said valving means toward an open position; and means in fluid communication with said off idle port and responsive to a specified vacuum level in said main venturi sensed through said off idle port adjacent said first throttle valve for moving said valving means toward a closed position, said engine operating on only said one-half of said cylinders when the vacuum sensed through said off idle port is above said specified level, said biasing means opening when said vacuum is below said specified level.

11. A split internal combustion engine having a full power stage of operation and an economy stage of operation, said engine comprising:

a first throttle valve to control the flow of air to one-half of said cylinders;

a second throttle valve to control the flow of air to the other half of said cylinders;

means connected to said second throttle valve and in fluid communication with the intake manifold of said one-half of said cylinders for moving said second throttle valve in response to vacuum variations in said intake manifold;

means in fluid communication with said moving means and said intake manifold for reducing gradually the vacuum environment sensed by said moving means so that said second throttle valve will not open immediately when said vacuum drops immediately;

a first fuel path in the carburetor of said engine to supply fuel to said one-half of said cylinders;

a second fuel path in said carburetor to supply fuel to said other half of said cylinders; and means located in said second fuel path and responsive to the vacuum level in the main venturi of said carburetor adjacent said first throttle valve for metering the flow of fuel in said second fuel path, said metering means blocking said fuel flow in said second fuel path when said vacuum in said venturi reaches a specified level, said metering means allowing the flow of fuel through said second fuel path when the vacuum in said venturi drops below a specified level, said reducing means preventing an immediate opening of said second throttle valve by said moving means when said vacuum in said intake manifold concurrently drops below said specified level, so that a sufficient amount of fuel will flow toward said second throttle valve before it opens to provide an adequate fuel and air mixture before said second throttle valve opens, preventing possible misfire of said engine.

12. A multiple combustion chamber internal combustion engine comprising:

means for independently supplying fuel to first and second fractions of said multiple combustion chambers; and means connected to said fuel supply means and responsive to the power demand of said engine for continuously prohibiting said fuel supplying means from supplying fuel during multiple engine revolutions to said first and second fractions in response to successive low power demands of said engine.

13. A multiple combustion chamber internal combustion engine comprising:

independent first and second means for supplying fuel to a first and second fraction of said multiple combustion chambers, respectively; and means responsive to the power demand on said engine and connected to said fuel supplying means for alternately:

(a) actuating said first fuel supplying means while deactuating said second fuel supplying means during plural engine revolutions;

(b) actuating said first and second fuel supplying means; and (c) actuating said second fuel supplying means while deactuating said first fuel supplying means during plural engine revolutions.

14. A method of operating a multiple combustion chamber engine, comprising:

(1) combusting fuel only in a first group of said multiple combustion chambers during multiple engine revolutions;

(2) thereafter combusting fuel in all of said multiple combustion chambers;

(3) thereafter combusting fuel only in a second group of said multiple combustion chambers during multiple engine revolutions;

(4) thereafter combusting fuel in all of said multiple combustion chambers; and (5) thereafter repeating steps 1 through 5.

* * * * *